US007086353B2

(12) United States Patent
Hwang et al.

(10) Patent No.: US 7,086,353 B2
(45) Date of Patent: Aug. 8, 2006

(54) LANCE SYSTEM FOR INTER-TUBE INSPECTING AND LANCING AS WELL AS BARREL SPRAYING OF HEAT TRANSFER TUBES OF STEAM GENERATOR IN NUCLEAR POWER PLANT

(75) Inventors: Kwon Sang Hwang, Daejeon (KR); Hyung Jin Sung, Daejeon (KR); Woo Tae Jeong, Daejeon (KR); Sung Yull Hong, Seo-gu Daejeon (KR)

(73) Assignee: Korea Electric Power Corporation (KR)

( * ) Notice: Subject to any disclaimer, the term of this patent is extended or adjusted under 35 U.S.C. 154(b) by 228 days.

(21) Appl. No.: 10/900,521

(22) Filed: Jul. 28, 2004

(65) Prior Publication Data

US 2005/0235927 A1 Oct. 27, 2005

(30) Foreign Application Priority Data

Apr. 23, 2004 (KR) ..... 10-2004-0028301

(51) Int. Cl.
*F22B 37/48* (2006.01)

(52) U.S. Cl. ..... 122/380; 122/379; 15/316.1; 239/750

(58) Field of Classification Search ..... 122/379, 122/380, 384; 239/750, 751, 752; 15/316.1, 15/317, 318, 318.1
See application file for complete search history.

(56) References Cited

U.S. PATENT DOCUMENTS 5,036,871 A * 8/1991 Ruggieri et al. ..... 134/167 R
5,564,371 A * 10/1996 Ashton et al. ..... 122/392
5,687,449 A * 11/1997 Zachay et al. ..... 15/316.1
5,741,130 A * 4/1998 Hagstrom et al. ..... 432/2
5,752,288 A * 5/1998 Parkin et al. ..... 15/316.1
6,681,839 B1 * 1/2004 Balzer ..... 165/11.2

* cited by examiner

*Primary Examiner*—Gregory A. Wilson
(74) *Attorney, Agent, or Firm*—Cantor Colburn LLP

(57) ABSTRACT

Disclosed is a lance system for inter-tube inspecting and lancing as well as barrel spraying of heat transfer tubes of a steam generator in a nuclear power plant, so that foreign substances piled up around heat transfer tubes in the steam generator are removed using high-pressure water. The lance system includes a rigid guide support rail positioned above a Blow Down Lane (BDL) at the center of the steam generator, a locomotion box including a motor drive unit for inducing a rectilinear motion of a lance body and a motor drive unit for inducing a rotational motion of the lance body centering on a horizontal axis, the lance body including a circular barrel including a motor drive unit for vertically erecting or horizontally laying down a multistage circular pole assembly, and a flat plate provided with linear passages for passing high-pressure water hoses, an optical cable and control rods therethrough, a circular drum assembly for stably connecting the high-pressure water hoses, the optical cable and the control rods, and the multistage circular pole assembly being extensible and contractible by the movement of the control rods obtained by engaging teeth of a toothed belt unit, driven by a motor and positioned in the circular barrel, with gear teeth of the control rods, and two nozzle blocks, for barrel spraying, provided with barrel spray nozzles fixedly assembled therewith, symmetrically fixed to the inner surface of the circular barrel, wherein the multi-stage circular pole assembly is vertically erected in the operation of inter-tube lancing and inspecting, in which the lance system approaches inner parts of the heat transfer tubes and sprays the high-pressure water thereto, and is maintained in a horizontally laid-down position in the operation of barrel spraying.

9 Claims, 10 Drawing Sheets

LANCE SYSTEM FOR INTER-TUBE INSPECTING AND LANCING AS WELL AS BARREL SPRAYING OF HEAT TRANSFER TUBES OF STEAM GENERATOR IN NUCLEAR POWER PLANT

BACKGROUND OF THE INVENTION

1. Field of the Invention

The present invention relates to a lance system, for inter-tube inspecting and lancing as well as barrel spraying of heat transfer tubes of a steam generator in a nuclear power plant, in which foreign substances, such as sludge deposits piled up around heat transfer tubes, are inspected or removed by spraying high-pressure water.

2. Description of the Related Art

As well known to those skilled in the art, a nuclear power plant rotates a turbine by means of the force of steam generated by heating water using heat generated by nuclear fission of uranium, and operates a power generator using the above rotary force, thereby producing electricity. Heat transfer tubes are densely arranged in a steam generator. Since water of a high temperature, which is contaminated with radioactivity, flows inside the heat transfer tubes, and water of a low temperature, which is not contaminated with radioactivity, flows outside the heat transfer tubes, the above waters are heat-exchanged and the contaminated water is converted into steam of a high-temperature and a high-pressure. The force of the steam rotates the turbine and the generator, thereby generating electricity.

Sludge is piled up in the steam generator, as operating time goes by, deteriorates heat efficiency of the heat transfer tubes in the steam generator, and damages the heat transfer tubes, thereby shortening the overall life span of the steam generator. The above sludge mainly contains oxidized steel and oxidized copper, and is cohered, in case that the sludge is not removed from the steam generator, and is then stuck between the heat transfer tubes, thereby causing heat stress. Further, the sludge, together with water, flows, and wears the heat transfer tubes.

In order to reduce the negative influence of the sludge on the life span of the steam generator, there are suggested equipment and procedures for discharging a designated amount of cooling water from a steam generator to the outside during the operation of the steam generator. However, using these equipment and procedures, it is impossible to effectively remove sludge deposits from the steam generator.

Accordingly, manufacturers of steam generators recommend users to periodically lance the inside of the steam generator within a preventive maintenance and inspection period every year.

Conventionally, there are suggested various lance systems, which rectilinearly move back and forth along a no tube lane (also called a "blow down lane (BLD)") at a central line of a steam generator and spray high-pressure water at an angle of 90 degrees in a moving direction. In the earlier stage of the inventions, a nozzle head, provided with two arrays of nozzles arranged apart at an angle of 180 degrees or less, which is attached to an end of a circular rod, was introduced. Here, high-pressure water ejected from both directions could cover all the regions of heat transfer tubes by rotating the circular rod from the outside of the steam generator.

However, in the above conventional lance systems, there exists a high possibility that the nozzle head experiences excessive vibration, when the nozzle head moves to the inner part of the steam generator, caused by an imbalance of the repulsive forces of the high-pressure water ejected from both directions during lancing, thereby being capable of seriously damaging the surfaces of the heat transfer tubes.

In case that the two arrays of nozzles attached to the nozzle head are arranged apart at an angle less than 180 degrees, strong repulsive force is imposed on the end of the circular rod, thus causing permanent deformation of the circular rod.

In order to overcome the above problems, one of the conventional lance systems employed a rigid guide support rail with a groove, which is tightly fixed by two hand holes on the wall of the steam generator spaced apart by an angle of 180 degrees or by a hand hole and a central support rod stationed near the center of the steam generator. The above lance system can move back and forth automatically along the guide support rail by the operation of a motor drive unit. That is, the lance system carries out lancing by ejecting high-pressure water by moving along the guide support rail. Thereby, it is possible to improve the overall efficiency of the lancing procedure without damaging the heat transfer tubes.

Recently, there is raised a necessity to remove hard sludge deposits, piled up around the heat transfer tubes, which are reported to be hard to remove by the above-described general lance method of ejecting high-pressure water at an angle of 90 degrees along the BDL. Many attempts to solve the above problem have been undertaken by EPRI, which is technically supported by Foster-Miller. The most effective methods were to increase the ejection pressure and the flow rate of the high-pressure water and to reduce the distance between nozzles for ejecting high-pressure water and targeted sludge deposits. The former had several technical problems, and the latter employed flexible means which could be bent by an angle of 90 degrees along the BDL so that the lance system could approach the inner parts of the heat transfer tubes.

That is, using the latter, the lance system could directly eject the high-pressure water just over the targeted sludge deposits.

The motivation and purpose of the application is quite similar to the latter, but the approaches to the inter-tube lance are quite different from the latter.

SUMMARY OF THE INVENTION

Therefore, the present invention has been made in view of the above problems, and it is an object of the present invention to provide a lance system for inspection and lancing of a steam generator, which approaches a structure having a geometric shape, such as the steam generator of a nuclear power plant.

It is another object of the present invention to provide a lance system, which approaches an inner part in a steam generator in a nuclear power plant or other structure, which is difficult to approach, using hand holes formed therein, thereby fixing an end of a rigid guide support rail to the hand holes so that the lance system easily moves back and forth.

It is yet another object of the present invention to provide a lance system, in which an inter-tube lancing apparatus, approaching inner parts of heat transfer tubes for spraying high-pressure water just over targeted sludge deposits, and a barrel spraying apparatus, positioned above a BDL for spraying the high-pressure water at an angle of 90 degrees, are combined together, but each performance is independently carried out.

It is a further object of the present invention to provide a lance and inspection system, in which a multistage circular pole assembly is maintained in a laid-down position in the operation of barrel spray, and is vertically erected in the operation of inter-tube lancing, and the length of the multistage circular pole assembly is extensible and contractible to reach a designated position of targeted sludge deposits.

In accordance with the present invention, the above and other objects can be accomplished by the provision of a lance system for inter-tube inspecting and lancing as well as barrel spraying of heat transfer tubes of a steam generator in a nuclear power plant, so that foreign substances piled up around heat transfer tubes in the steam generator are removed using high-pressure water, comprising: a rigid guide support rail positioned above a Blow Down Lane (BDL) at the center of the steam generator; a locomotion box including a motor drive unit for inducing a rectilinear motion of a lance body, and a motor drive unit for inducing a rotational motion of the lance body centering on a horizontal axis; the lance body including: a circular barrel including a motor drive unit for vertically erecting or horizontally laying down a multistage circular pole assembly, and a flat plate provided with linear passages for passing high-pressure water hoses, an optical cable and control rods therethrough; a circular drum assembly for stably connecting the high-pressure water hoses, the optical cable and the control rods; and the multistage circular pole assembly being extensible and contractible by the movement of the control rods obtained by engaging teeth of a toothed belt unit, driven by a motor and positioned in the circular barrel, with gear teeth of the control rods; and two nozzle blocks, for barrel spraying, provided with barrel spray nozzles fixedly assembled therewith, symmetrically fixed to the inner surface of the circular barrel, wherein the multistage circular pole assembly is vertically erected in the operation of inter-tube lancing and inspecting, in which the lance system approaches inner parts of the heat transfer tubes and sprays the high-pressure water thereto, and is maintained in a horizontally laid-down position in the operation of barrel spraying.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 9:
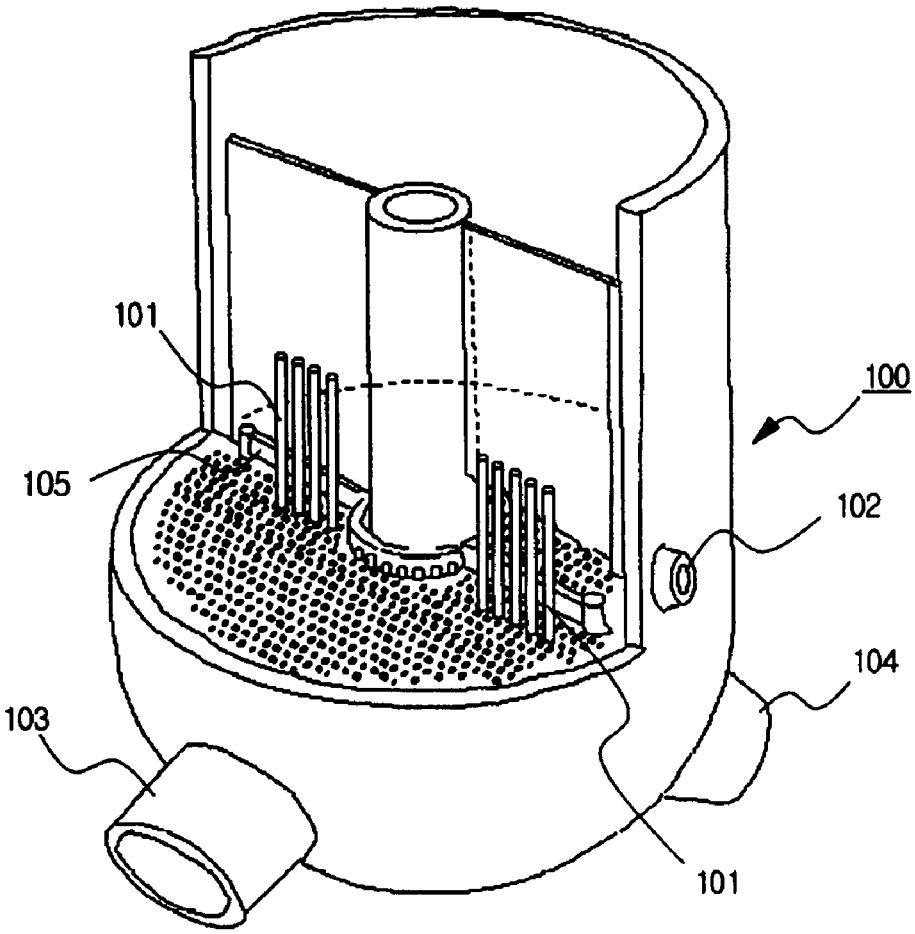
FIG. 9 is an exploded perspective view illustrating the inside of a conventional steam generator installed in a nuclear power plant.

As shown in FIG. 9, a lance system 1 of the present invention serves to inspect or lance sludge piled up around heat transfer tubes 101 of a steam generator 100 provided with a high-temperature water inlet 103 and a low-temperature water outlet 104, and is installed in a nuclear power plant through a handling hole 102.

The lance system 1 of the present invention serves to remove foreign substances piled up around the heat transfer tubes 101 in the steam generator 100 using high-pressure water, and comprises a rigid guide support rail 2, a locomotion box 3, and a lance body 4. The rigid guide support rail 2 is arranged above a BDL (Blow Down Lane) 105 positioned at the center of the steam generator 100. The locomotion box 3 includes a motor drive unit 10 for inducing a rectilinear motion of the lance body 4 along the rigid guide support rail 2, and a motor drive unit 41 for inducing a rotational motion of the lance body 4 centering on a horizontal axis along the rigid guide support rail 2. The lance body 4 includes a circular barrel 11, a circular drum assembly 12, and a multistage circular pole assembly 13. The circular barrel 11 includes a motor drive unit 14 for vertically erecting or horizontally laying down the multistage circular pole assembly 13, and a flat plate 17 provided with linear passages for passing high-pressure water hoses, an optical cable and control rods 26 therethrough. The circular drum assembly 12 serves to stably connect the high-pressure water hoses, the optical cable and the control rods 26 to the nozzle block 28 through the multistage circular pole assembly 13, and the multistage circular pole assembly 13 is extensible and contractible by the movement of the control rods 26. A toothed belt unit 22 and a motor 21 for operating the toothed belt unit 22 are installed in the circular barrel 11. Teeth of the toothed belt unit 22 are engaged with gear teeth of the control rods 26. Thereby, in case that the lance system approaches the inner part of the heat transfer tube 101 and sprays high-pressure water for lancing and inspecting the heat transfer tube 101, the multiple circular pole assembly 13 is maintained in the erected state. Here, two nozzle blocks 42 for barrel spray are symmetrically installed at the inner surface of the circular barrel 11, and barrel spray nozzles 43 of the nozzle blocks 42 are fixed to the outer surface of the circular barrel 11. In case that the lance system performs barrel spraying, the multistage circular pole assembly 13 is maintained in the horizontally laid-down state.

The lance system of the present invention can simultaneously perform barrel spray, in which the lance system downwardly sprays high-pressure water into the steam generator 100 at an angle of 90 degrees for removing sludge piled up around the heat transfer tubes 101 of the steam generator 100, and inter-tube spray, in which the lance system approaches the inner part of the heat transfer tube 101 and then directly sprays high-pressure water thereto.

Figure 1:
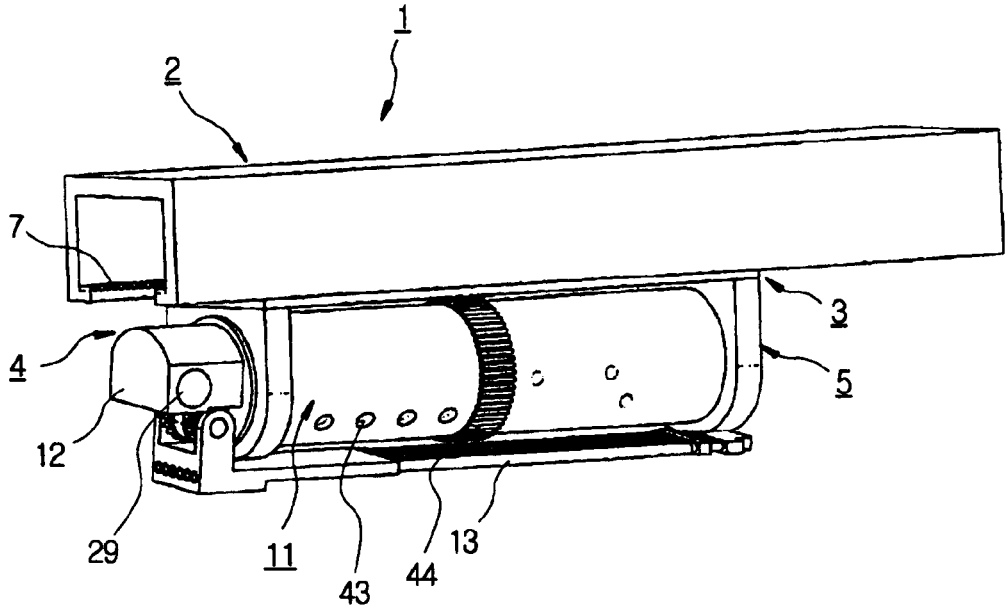
FIG. 1 is a general perspective view of a lance system for inter-tube inspecting and lancing of heat transfer tubes of a steam generator according to the present invention.
Figure 2:
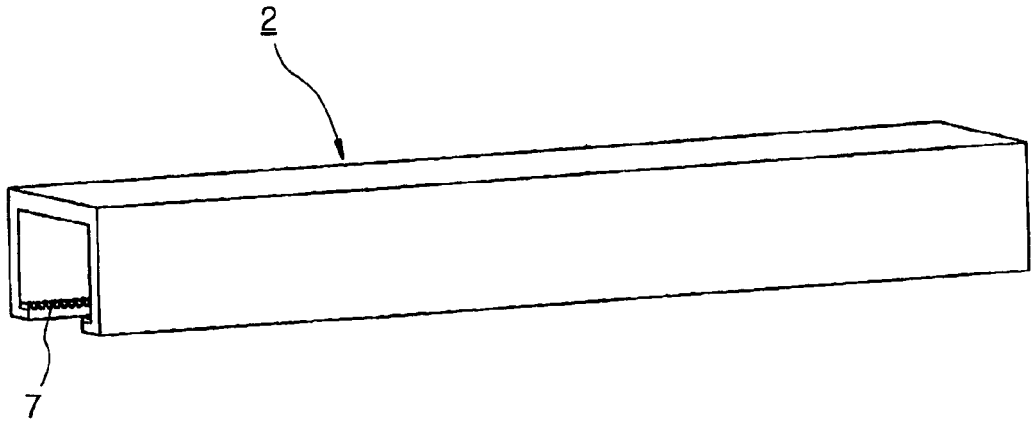
FIG. 2 is a detailed perspective view of a guide support rail of the lance system shown in FIG. 1.

That is, the rigid guide support rail 2 is arranged above the BDL shown in FIG. 9. As shown in FIGS. 1 and 2, the rigid guide support rail 2 is structured to have a C-shape in order to guide the locomotion box 3 connected to the lance body 4 by two support blocks 5, and a pair of rack gears 7 for embracing the locomotion box 3 are formed on both sides of the bottom of the rigid guide support rail 2. The rack gears 7 are respectively engaged with two pairs of pinion gears 8 and 9 extruded from the side surfaces of the locomotion box 3.

As shown in FIG. 3, the pinion gears 8 positioned at the front portion of the locomotion box 3 are driven by the motor drive unit 10 installed inside the locomotion box 3.

Further, the pinion gears 9 positioned at the rear portion of the locomotion box 3 are dummy gears installed to secure the stable linear movement of the lance body 4 along the rigid guide support rail 2.

Figure 4A:
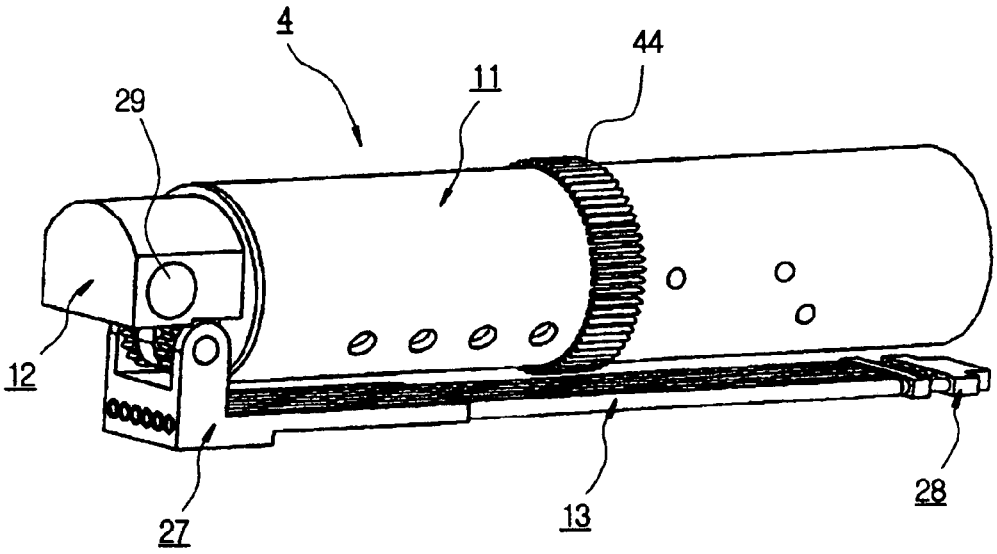
FIG. 4*a* is a detailed perspective view of a lance body of the lance system shown in FIG. 1.

As shown in FIG. 4, the lance body 4 includes the circular barrel 11, the circular drum assembly 12 and the multistage circular pole assembly 13. The circular barrel 11 includes the motor drive unit 14 for vertically erecting or horizontally laying down the multistage circular pole assembly 13.

The motor drive unit 14 drives a rotary shaft provided with two pinion gears 15, which are installed inside the circular barrel 11. The pinion gears 15 are engaged with two pinion gears 15 fixed to a rotary shaft of the multistage circular pole assembly 13. The circular barrel 11 further includes the flat plate 17 provided with the linear passages 18 and 19 for passing the high-pressure water hoses, the optical cable and the control rods 26 therethrough. The control rods 26 serve to control the length of the multistage circular pole assembly 13. The circular barrel 11 further includes a motor drive unit 20 for inducing the extension and contraction of the multistage circular pole assembly 13.

Figure 4B:
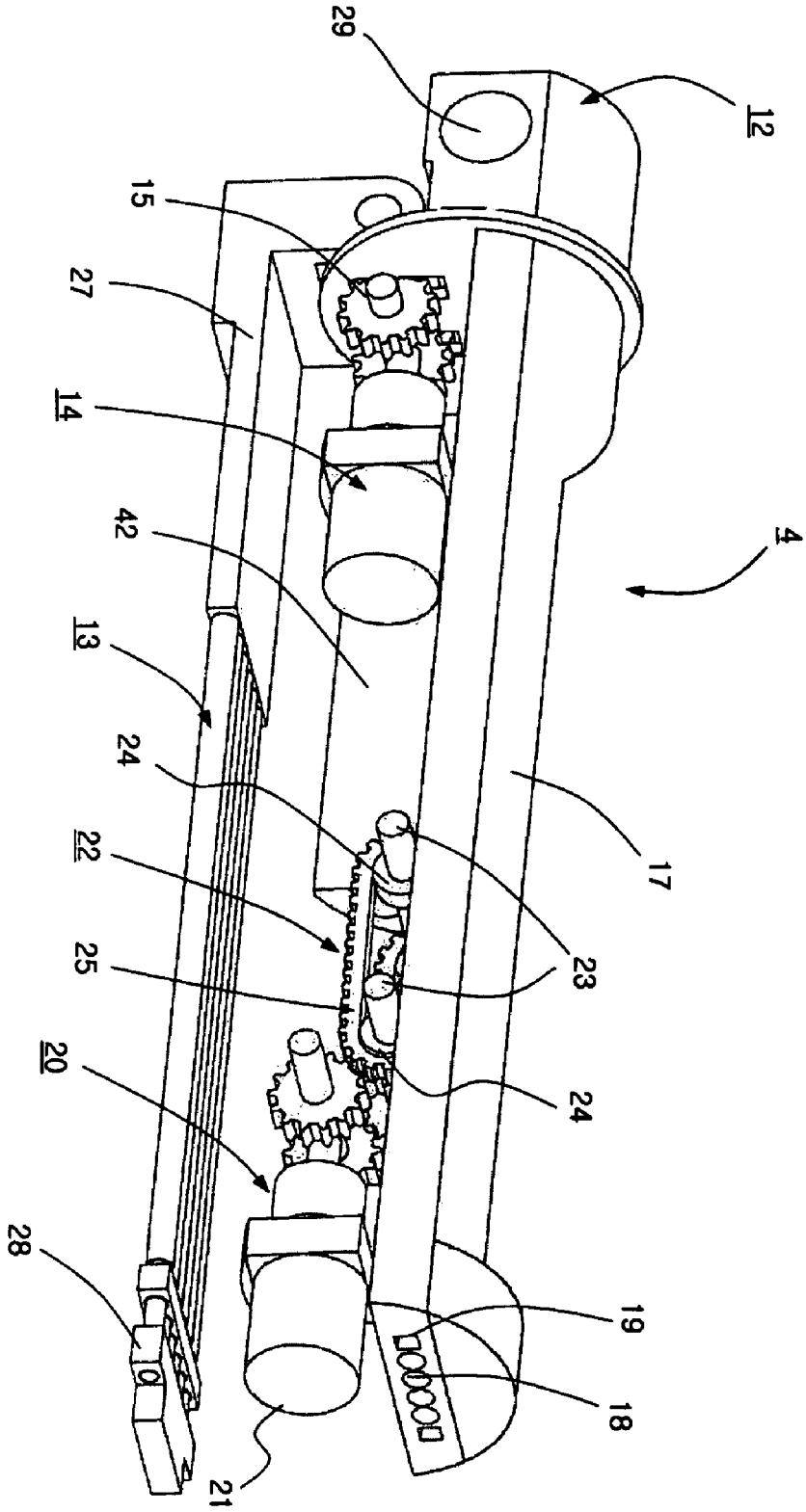
FIG. 4*b* is a perspective view illustrating the inside of the lance body of FIG. 4*a;*

As shown in FIGS. 4*b* and 5, the motor drive unit 20 includes the motor 21, and the toothed belt unit 22 driven by the motor 21. The toothed belt unit 22 has two rotary shafts 23 respectively provided with two pairs of pinion gears 24 connected thereto, and two toothed belts 25 respectively engaged with the corresponding pairs of the pinion gears 24.

The rotary shafts 23 of the toothed belt unit 22 are fixed to the circular barrel 11. Other pinion gears engaged with pinion gears driven by the motor 21 are connected to the rear rotary shaft 23. The teeth of the belt 25 are engaged with the two control rods 26 passing through the flat plate 17 installed inside the circular barrel 11.

Figure 5A:
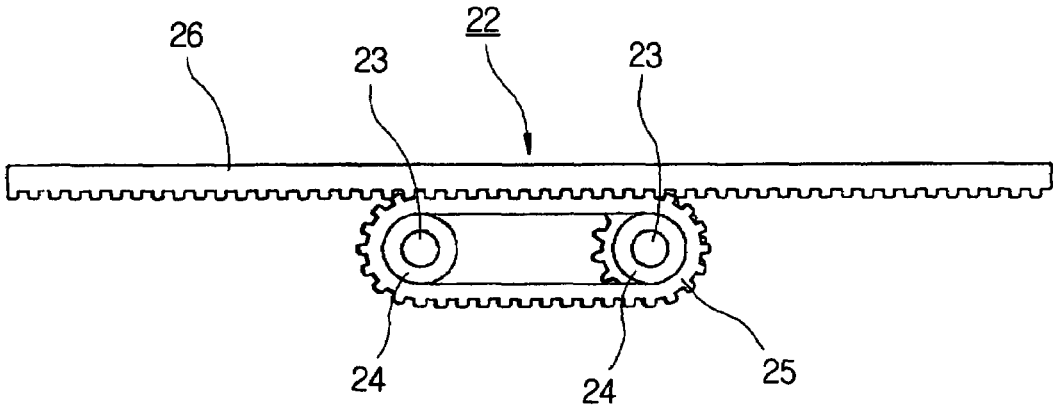
FIG. 5*a* is a side view of a toothed belt system of the lance system according to the present invention.
Figure 5B:
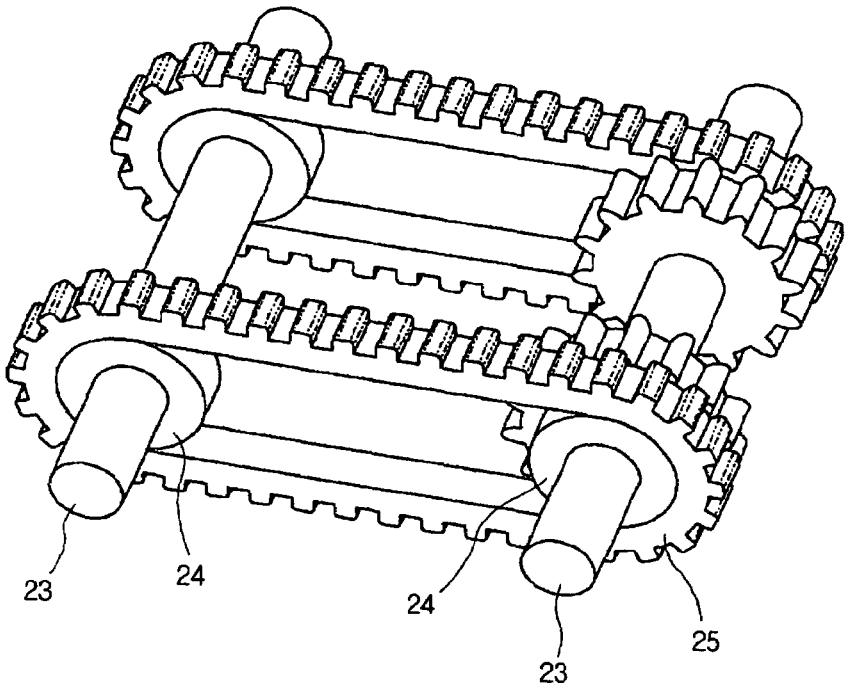
FIG. 5*b* is a perspective view of a driving unit of the toothed belt system of FIG. 5*a;*

Here, when the rotary shafts 23 of the toothed belt unit 22 are rotated, the control rods 26 engaged with the belts 25 perform a frontward and backward rectilinear motion to extend and contract the length of the multistage circular pole assembly 13, thereby varying the position of a nozzle block 28 fixed to a distal end of the multistage circular pole assembly 13. As shown in FIGS. 5*a* and 5*b*, increase of the contacting area of the toothed belt unit 22 with the control rods 26 guarantees more stable extension and contraction of the multistage circular pole assembly 13.

Figure 6A:
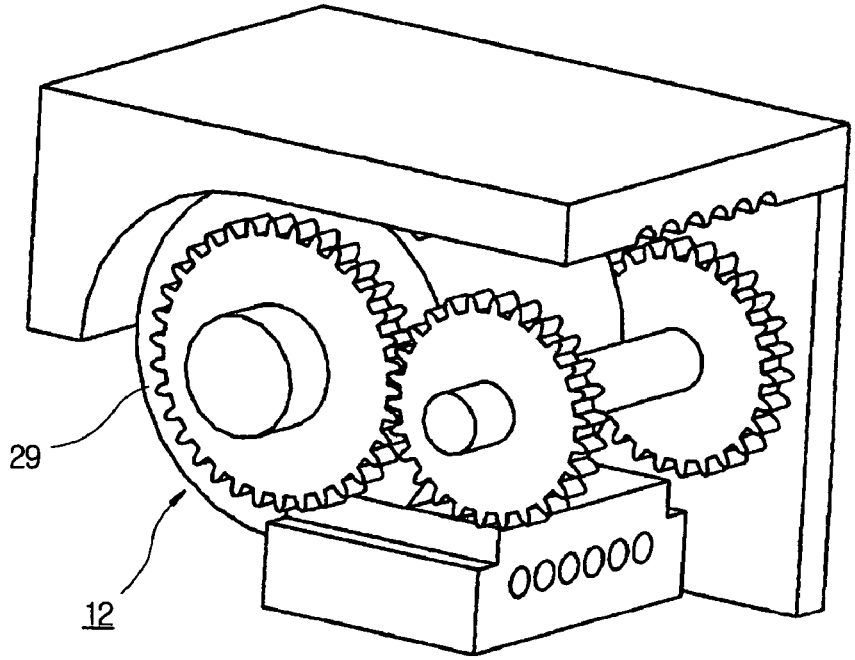
FIG. 6*a* is a perspective view of a circular drum assembly of the lance system according to the present invention.
Figure 6B:
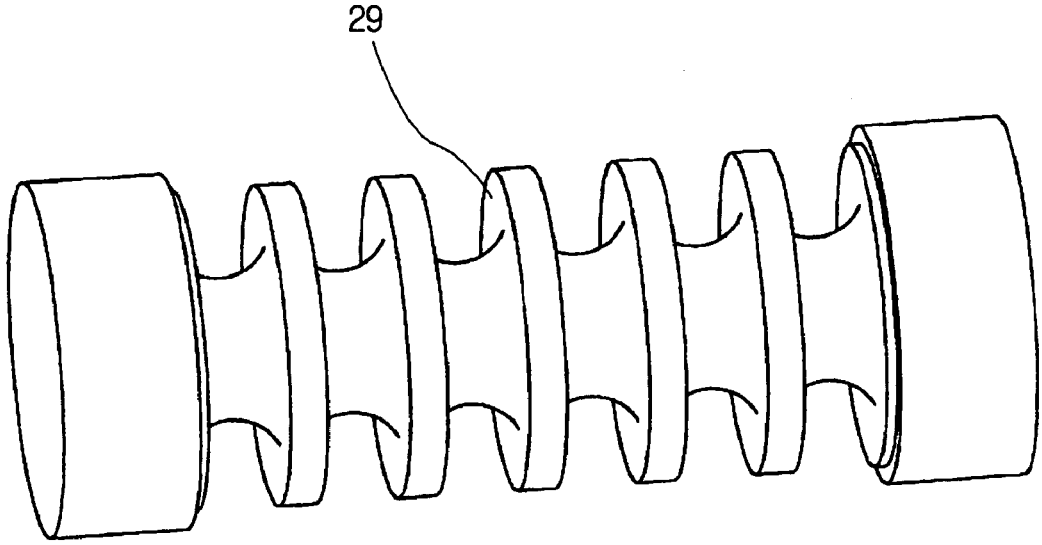
FIG. 6*b* is a perspective view of circular drums shown in FIG. 6*b;*

As shown in FIG. 6, circular drums 29 serve to stably connect the high-pressure water hoses, the optical cable and the control rods, which have passed through the flat plate 17 installed inside of the circular barrel 11, to the multistage circular pole assembly 13.

Accordingly, the surface of the circular drum assembly 12 is processed to provide passages having the same shape as those of the flat plate 17.

Figure 7A:
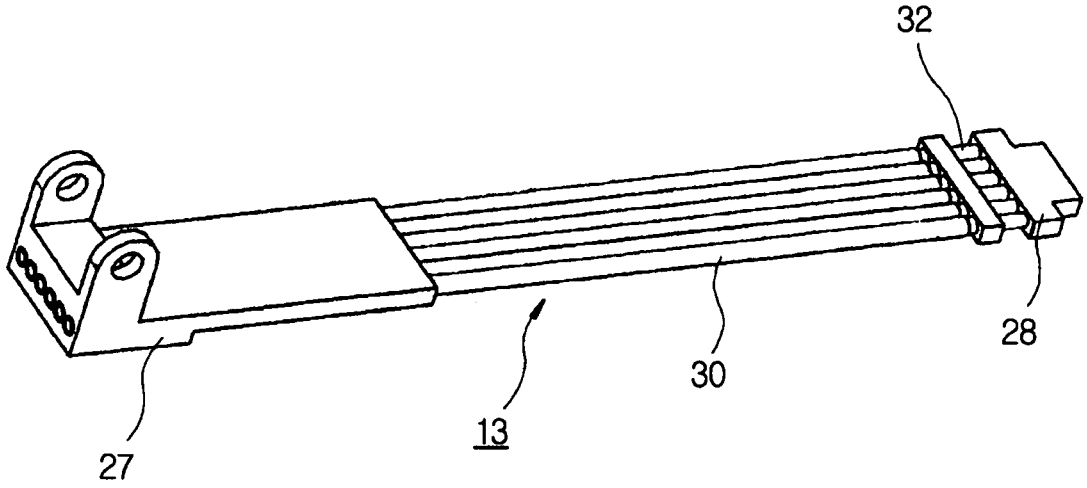
FIG. 7*a* is a perspective view of a multistage circular pole assembly of the lance system in accordance with one embodiment of the present invention.
Figure 7B:
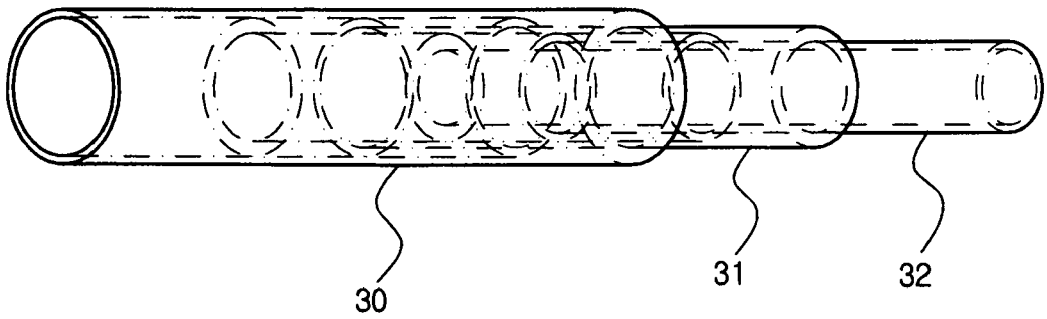
FIG. 7*b* is an enlarged perspective view of circular poles of FIG. 7*a;*

FIGS. 7*a* and 7*b* illustrate the above multistage circular pole assembly 13. The multistage circular pole assembly 13 is constructed to provide the linear passages 18 and 19 for the high-pressure water hoses, the optical cable and the control rods 26. One end of the multistage circular pole assembly 13 is fixed by a support plate 27, and the other end of the multistage circular pole assembly 13 is connected to the nozzle block 28.

As disclosed in the prior arts, the nozzle block 28 is equipped with nozzles for spraying high-pressure water, and an optical camera, and serves as a reservoir for containing the high-pressure water before ejecting.

FIGS. 7*a* and 7*b* illustrate the detailed structure of the multistage circular pole assembly 13. That is, a first circular pole 30 with the biggest diameter, of each of pole unit of the multistage circular pole assembly 13, positioned at the outermost area, has a portion of length contracted in inner diameter on its right end to keep a second pole 31 remained in connection in its full extension. Accordingly, the second pole 31 needs a portion of length with the same outer diameter as the inner diameter of the first pole on its left end, and a portion of length contracted in inner diameter on its right end in the same manner as the first pole 30. In this manner, the innermost pole 32 with the smallest diameter is designed to satisfy the same geometrical restrictions on its left and right ends, and is tightly fixed to the nozzle block 28.

Figure 8A:
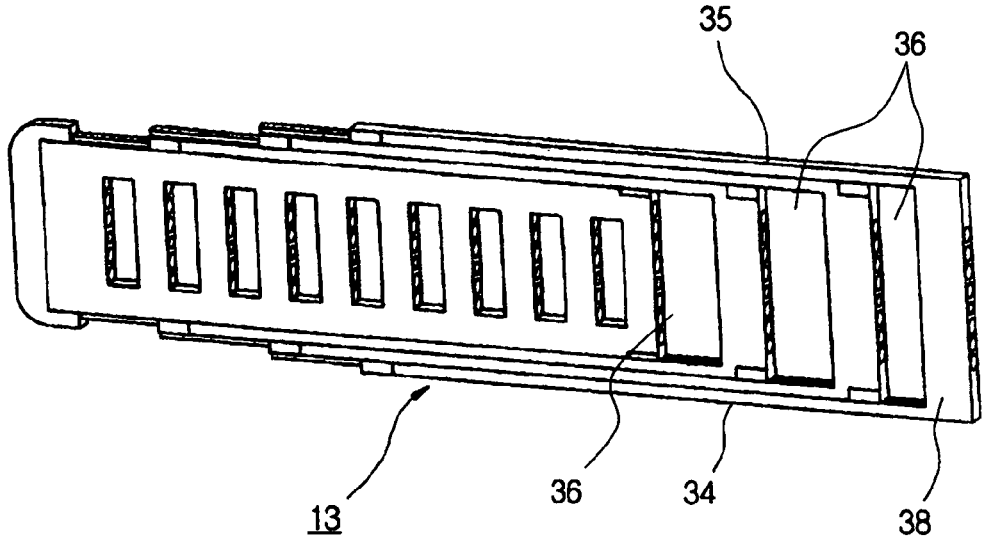
FIG. 8*a* is a perspective view of a multistage circular pole assembly, having a U-shaped structure, of the lance system in accordance with another embodiment of the present invention.
Figure 8B:
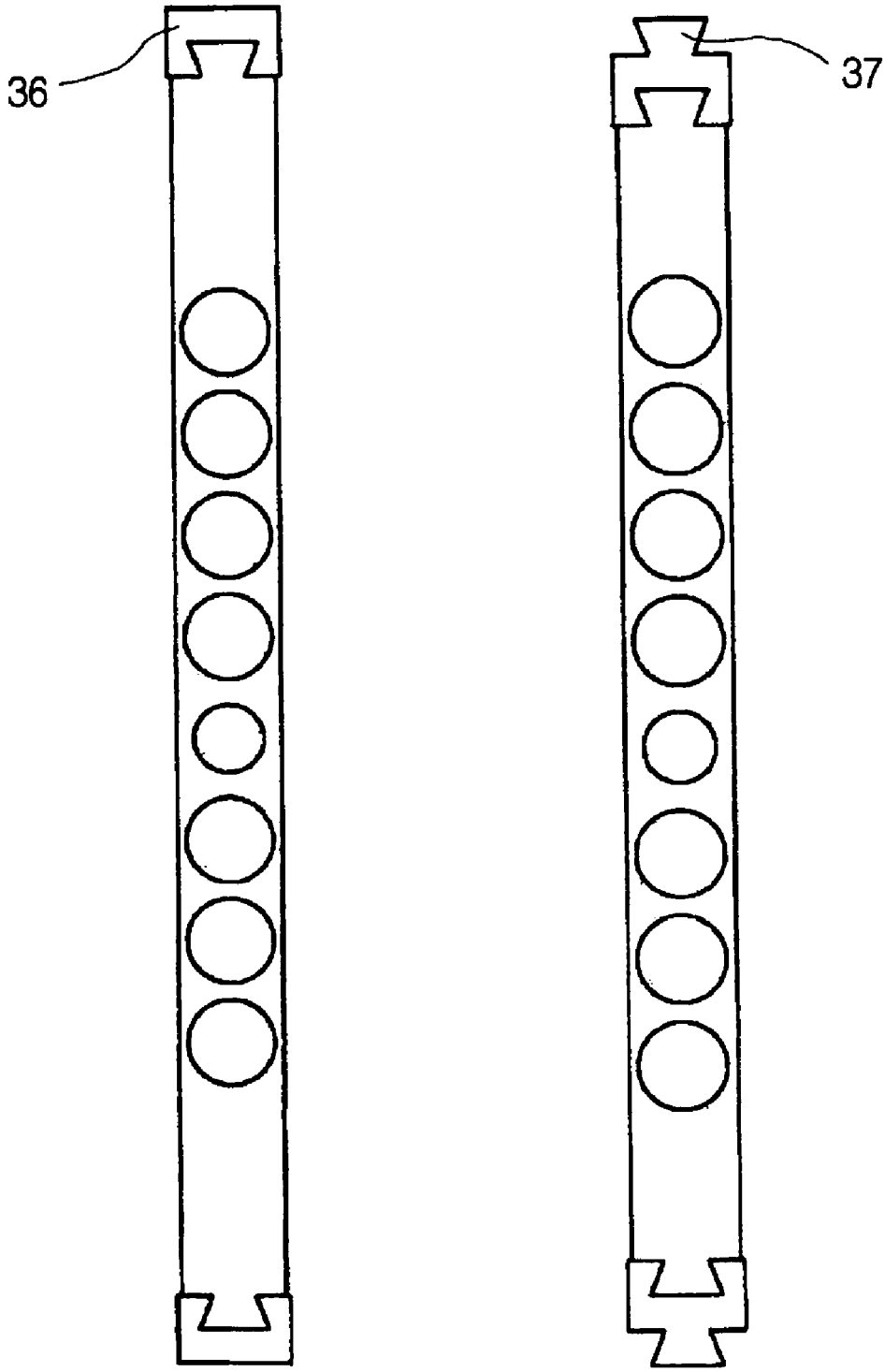
FIG. 8*b* is a cross-sectional view of components of the multistage circular pole assembly of FIG. 8*a*.

FIGS. 8*a* and 8*b* illustrate another embodiment of the multistage circular pole assembly 13 of the present invention. In this case, each of the poles of the multistage circular pole assembly 13 has a structure 34 with a laid-down U-shape. Lengthwise grooves 36 are formed through longitudinal parts of poles of the pole unit, and are designed so that protrusions 37 extruded from poles of the next pole unit are engaged with the corresponding lengthwise grooves 36 of the above pole unit, thereby allowing the pole units to be slid against each other. A vertical part 38 of each of the pole units of the multistage circular pole assembly is machined to have parallel passages for passing the high-pressure water hoses, the optical cable and the control rods therethrough. In the same manner as the earlier multistage circular pole assembly, the nozzle block 28 is fixed to the innermost pole. In this design, the widths of the longitudinal parts as well as the vertical parts of the poles are the same, but the heights of the vertical parts becomes smaller, as the number of poles of the pole unit increases. Due to the above-described structural characteristics, differently from the earlier multistage circular pole assembly, the dimensions of the passages, for passing the high-pressure water hoses, the optical cable and the control rods therethrough, are uniformly maintained regardless of the number of the poles of the pole unit. Consequently, high-pressure water hoses with a larger diameter than that of the earlier embodiment of the multistage circular pole assembly can be employed by the above embodiment of the multistage circular pole assembly, thereby increasing the flow rate of the high-pressure water and improving lancing effects and efficiency of the lance system.

Figure 3A:
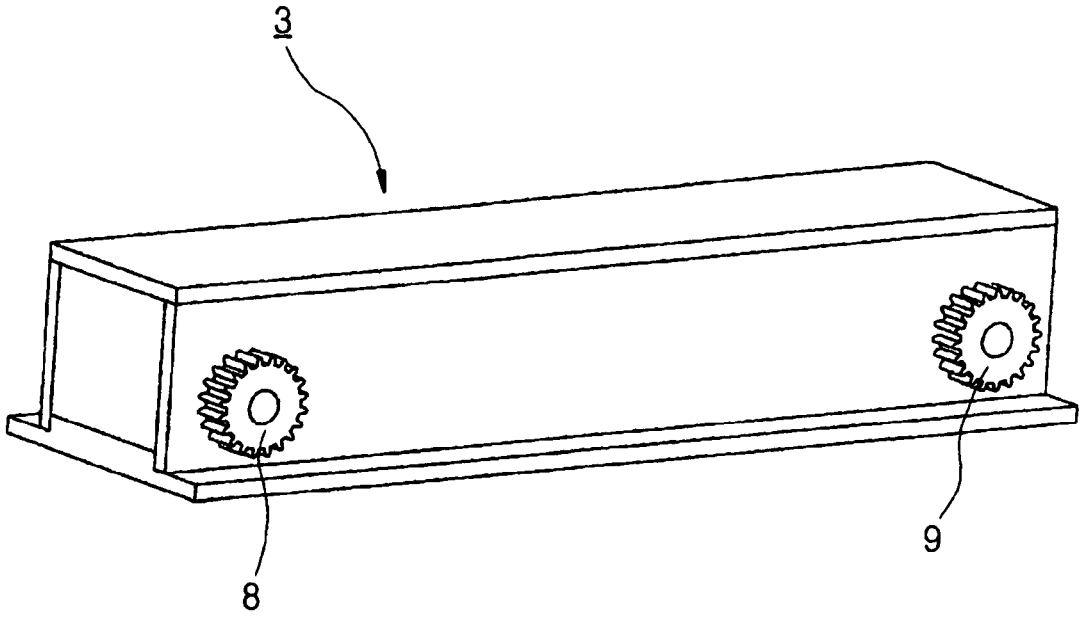
FIG. 3*a* is a detailed perspective view of a locomotion box of the lance system shown in FIG. 1.
Figure 3B:
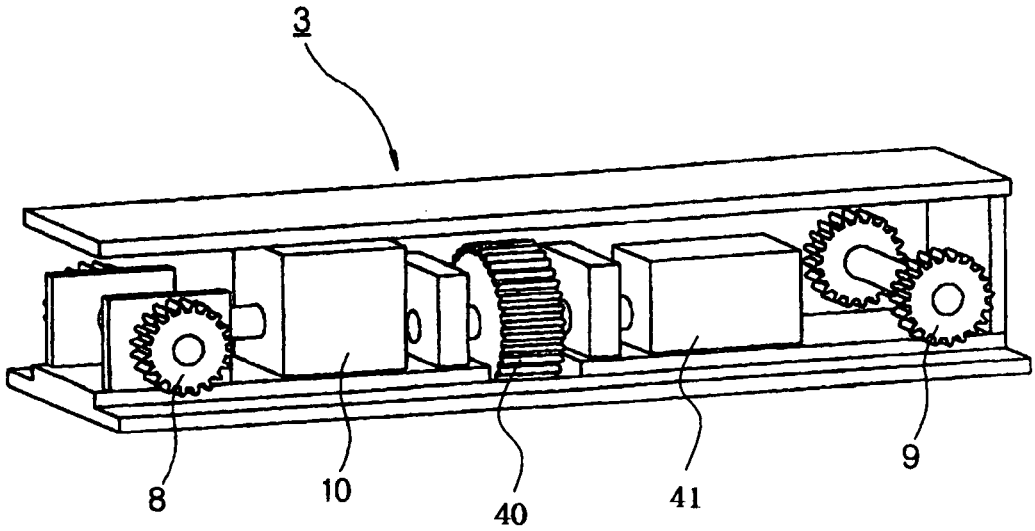
FIG. 3*b* is a perspective view illustrating the inside of the locomotion box of FIG. 3*a;*

Horizontal axial rotation motion of the circular barrel 11 is achieved by the motor drive unit 41 installed inside the above-mentioned locomotion box 3. As shown in FIGS. 3*a* and 3*b*, a pinion gear 40 fixed to a motor axis is engaged with a gear 44 formed on the outer surface of the circular barrel 11. The circular barrel 11 is fixed to the locomotion box 3 by the support blocks 5 positioned at front and rear ends of the circular barrel 11.

In addition to the inter-tube lancing, in which the lance system 1 approaches the inner part of the heat transfer tube 101 and then directly sprays high-pressure water thereto for removing or inspecting sludge deposits, the lance system 1 of the present invention is designed such that barrel spray can be performed by the lance system 1, in which the lance system 1 vertically downwardly sprays high-pressure water into the steam generator 100 at an angle of 90 degrees. The two nozzle blocks 42 for barrel spray are symmetrically fixed to the inner surface of the circular barrel 11. The nozzle blocks 42, contacting the inner surface of the circular barrel 11, are fixed to the circular barrel 1 by bolts of the barrel spray nozzles 43, and high-pressure water is supplied from the outside of the circular barrel 11 to the nozzle blocks 42 by the high-pressure water hoses.

The barrel spray nozzles 43 are fixedly assembled with the nozzle blocks 42 at the outside of the circular barrel 11.

Accordingly, in case that the barrel spray is carried out, the multistage circular pole assembly 13 is maintained in the horizontally laid-down position.

The overall operational mechanism of the inter-tube lancing and inspection of the lance system of the present invention is as follows.

First, the lance body 4 is carried to a desired position by the motor drive unit 10 positioned inside the locomotion box 3 along the rigid guide support rail 2 arranged above the BLD (Blow Down Lane).

Thereafter, the multistage circular pole assembly 13 is vertically erected by the operation of the motor drive unit 14 positioned inside the circular barrel 11.

Then, the circular barrel 11 and the multistage circular pole assembly 13 are rotated centering on a horizontal axis by the operation of the motor drive unit 41 positioned inside the locomotion box 3, thus being tilted at a desired angle.

The length of the multistage circular pole assembly 13 is extended by the operation of the motor drive unit 20, installed at the rear part of the circular barrel 11, and the toothed belt unit 22, thereby allowing the nozzle block 28 to reach a position just over targeted sludge deposits.

Finally, the lance system of the present invention at the above position sprays high-pressure water onto the steam generator, thereby removing the targeted sludge deposits.

As mentioned above, the extension of the length of the multistage circular pole assembly 13 is achieved by the movement of the control rods 26 driven by the operation of the motor drive unit 41. Here, the teeth of the belt 25 are engaged with the gears of the control rods 26. In order to carry out this engagement, the control rods 26 should be stiff enough to extend and contract the multistage circular pole assembly 13 to a designated length and be flexible enough to bend at an angle of 180 degrees after having passed through the flat plate 17 in the circular barrel 11 and the circular drum assembly 12 to be connected to the nozzle block.

As apparent from the above description, the present invention provides a lance system for removing foreign substances piled up around heat transfer tubes in a steam generator in a nuclear power plant, which simultaneously performs barrel spray, in which the lance system downwardly sprays high-pressure water into the steam generator at an angle of 90 degrees along a BDL (Blow Down Lane), and inter-tube spray, in which the lance system approaches the inner parts of the heat transfer tubes and then directly sprays high-pressure water thereto, thereby effectively lancing the steam generator compared to a conventional lance system employing only the barrel spray method.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A lance system for inter-tube inspecting and lancing as well as barrel spraying of heat transfer tubes of a steam generator in a nuclear power plant, so that foreign substances piled up around heat transfer tubes of the steam generator are removed by spraying high-pressure water thereto, comprising:

a rigid guide support rail positioned above a Blow Down Lane (BDL) at the center of the steam generator;

a locomotion box including a motor drive unit for inducing a rectilinear motion of a lance body, and a motor drive unit for inducing a rotational motion of the lance body centering on a horizontal axis;

the lance body including:

a circular barrel including a motor drive unit for vertically erecting or horizontally laying down a multistage circular pole assembly, and a flat plate provided with linear passages for passing high-pressure water hoses, an optical cable and control rods therethrough;

a circular drum assembly for stably connecting the high-pressure water hoses, the optical cable and the control rods to a nozzle block through the multistage circular pole assembly; and the multistage circular pole assembly being extensible and contractible by the movement of the control rods obtained by engaging teeth of a toothed belt unit, driven by a motor and positioned in the circular barrel, with gear teeth of the control rods; and two nozzle blocks, for barrel spraying, provided with barrel spray nozzles fixedly assembled therewith, symmetrically fixed to the inner surface of the circular barrel;

wherein the multistage circular pole assembly is vertically erected in the operation of inter-tube lancing and inspecting, in which the lance system approaches inner parts of the heat transfer tubes and sprays the high-pressure water thereto, and is maintained in a horizontally laid-down position in the operation of barrel spraying.

2. The lance system according to claim 1, wherein the multistage circular pole assembly includes a plurality of circular poles slidably connected to each other so that the length of the multistage circular pole assembly is extensible or contractible, and one ends of the circular poles are fixed by a support plate and the other ends of the circular poles are connected to a nozzle block.

3. The lance system according to claim 1, wherein the high-pressure water hoses, the optical cable and the control rods are supplied from the outside of the steam generator, pass through the flat plate installed inside the circular barrel, are connected to the multistage circular pole assembly over the circular drum assembly, and are then fixed to a nozzle block positioned at a distal end of the multistage circular pole assembly.

4. The lance system according to claim 1, wherein the control rods serve to extend or contract the length of the multistage circular pole assembly, are provided with the gear teeth engaged with teeth of a belt of the toothed belt unit, and are stiff enough to adjust the length of the multistage circular pole assembly or to withstand stress caused by repulsive force generated by the ejection of the high-pressure water and are flexible enough to bend at an angle of 180 degrees after having passed through the flat plate of the circular barrel to be connected to the multistage circular pole assembly.

5. The lance system according to claim 1, wherein a motor drive unit, installed at the rear part of the circular barrel, serves to operate the toothed belt unit provided with teeth engaged with the gear teeth of the control rods.

6. The lance system according to claim 1, wherein a motor drive unit, installed at the front part of the circular barrel, serves to operate a rotary shaft provided with two pinion gears installed inside of the circular barrel, and the pinion gears are engaged to two pinion gears fixed to a rotary shaft of the multistage circular rod assembly to vertically erect or horizontally laying down the multistage circular rod assembly.

7. The lance system according to claim 1, wherein the nozzle blocks, for barrel spraying, are symmetrically fixed to the inner surface of the circular barrel, one outer surface of each of the nozzle blocks has a diameter the same as the inner diameter of the circular barrel, and the nozzle blocks are fixed to the circular barrel by means of connection means installed on the nozzle blocks.

8. The lance system according to claim 1, wherein the rear surfaces of the nozzle blocks, for barrel spraying, are connected to a high-pressure hose supplied from the outside of the circular barrel.

9. The lance system according to claim 1, wherein the flat plate installed inside of the circular barrel is fixed above the two motor drive units, and provides passages for passing the high-pressure water hoses, the optical cable and the control rods therethrough.

* * * * *